United States Patent [19]

Fraser

[11] Patent Number: 4,813,468

[45] Date of Patent: Mar. 21, 1989

[54] TWO AND THREE POSITION OVER-UNDER WINDOW SHADE

[75] Inventor: Donald E. Fraser, Owensboro, Ky.

[73] Assignee: Hunter Douglas Inc., Saddle River, N.J.

[21] Appl. No.: 94,228

[22] Filed: Sep. 8, 1987

[51] Int. Cl.[4] ..... E06B 9/30

[52] U.S. Cl. ..... 160/84.1; 160/168.1

[58] Field of Search ..... 160/84 R, 236, 201, 160/178 C, 166 A, 172, 168.1

[56] References Cited

U.S. PATENT DOCUMENTS 2,201,356 5/1940 Terrell .
2,646,114 8/1951 Kearny .
4,673,600 6/1987 Anderson ..... 160/84 R X

FOREIGN PATENT DOCUMENTS 61284 9/1943 Denmark ..... 160/84 R
1195484 11/1959 France .

*Primary Examiner*—Blair M. Johnson
*Attorney, Agent, or Firm*—Pennie & Edmonds

[57] ABSTRACT

Two and three position over-under shades having at least three horizontal rails separated by pleated blinds. Single or double lift cords are provided to control the raising and lowering of the blinds. Material for the individual blinds may be any material which exhibits suitable properties and meets the aesthetic requirements of the user, this includes translucent single pleated fabric, honeycomb pleated material providing significant thermal insulation, or even insect screen. A blind may be omitted leaving the rail below suspended by its lift cord and providing an opening without raising the entire shade. The design allows a choice of window coverings to be in place and provides different window coverings while maintaining a uniform appearance.

6 Claims, 6 Drawing Sheets

TWO AND THREE POSITION OVER-UNDER WINDOW SHADE

BACKGROUND OF THE INVENTION

The invention relates to window shades and more particularly to a window shade having multiple positions offering different amounts of light and thermal insulation.

In the furnishing of a room it is often desirable to control the amount of light which enters through the windows. At the same time it may be desired to control the amount of heat which may enter or exit through the window glass. In the past this has required various combinations of curtains and blinds. This can be expensive and may create a cluttered appearance in the room. Even expensive, well designed curtains and blinds alter the appearance of the window opening when used in different configurations. Therefore, it would be an improvement to provide a single shade which fulfills these requirements while at the same time having simple and aesthetic appearance.

It is therefore an object of this invention to provide a means for controlling the amount of light entering a room while at the same time controlling the amount of heat transfer through the window.

It is a further object of the invention to achieve the aforementioned control while maintaining a simple and aesthetic appearance which need not change when the shade position is altered.

Another object of the invention is to provide a single window shade which would allow the changing of color and or material in the window opening without removing or replacing shades.

SUMMARY OF THE INVENTION

These and other objects of the invention are achieved by providing a single shade assembly with a number of blinds and horizontal support rails.

In the basic embodiment of the invention three horizontal rails, a head rail, a midrail and a bottom rail, are separated by two pleated blinds. It is contemplated that at least one of the blinds would be made of a thin, relatively translucent material and the second of a double layer honeycomb fabric. By providing a single set of lift cords attached to the midrail and passing through the head rail, wherein a locking device may be provided, the midrail may be moved up and down, alternatively selecting between first or second blind.

In another embodiment a second set of lift cords may be added which extends through the midrail and second blind is attached to the bottom rail. The second set of lift cords allows the entire shade to be lifted so that the window is unobstructed or it allows the second shade to be used by itself with first shade collapsed to the top and held in place by the first lift cord.

With this basic structure an infinite number of combinations are possible. Additional blinds and rails may be added to the bottom, controlled by additional lift cords. Blinds of similar material but different color may be used to alter the appearance of the room, or one blind may be left out in order to provide an open space without raising the whole shade all the way to the top.

DETAILED DESCRIPTION OF THE INVENTION

Figure 1:
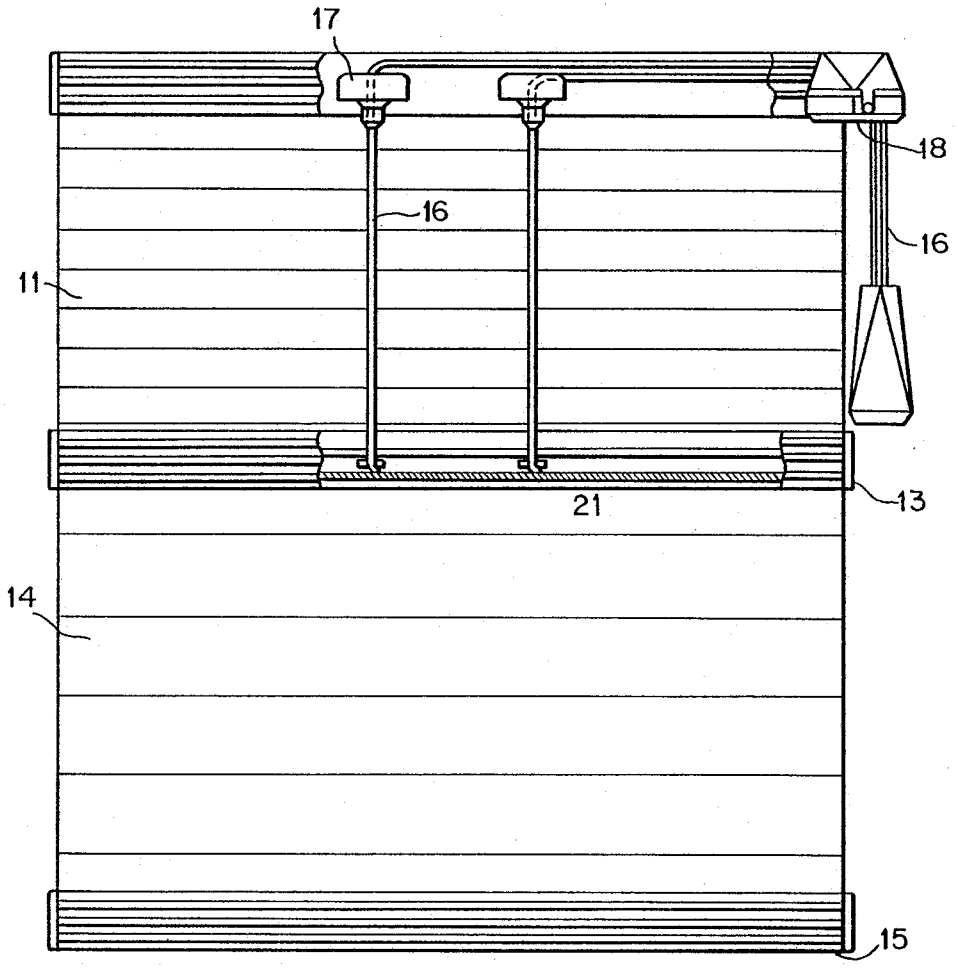
FIG. 1 shows an elevation view of a two position over-under shade of the present invention.
Figure 2:
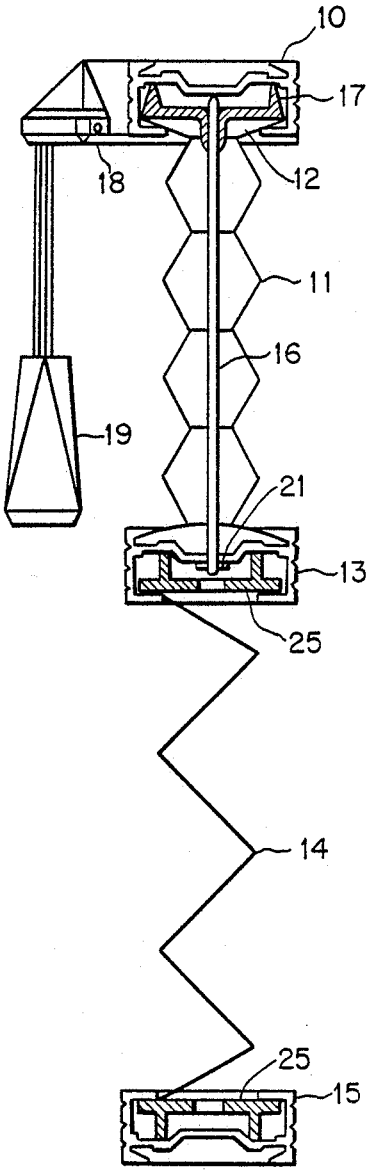
FIG. 2 shows an end view of the shade shown in FIG. 1.

The two position over-under shade of the present invention is shown generally in FIGS. 1 and 2. A head rail 10 provides the basic foundation for the shade. A first blind 11, made of two side-by-side layers of single pleat material, is suspended from the head rail 10 by means of a filler strip 12. A midrail 13 is suspended from the bottom of the first blind 11. The midrail 13 provides rigidity to the bottom of the first blind 11 and supports a second blind 14 which is suspended from the bottom of the midrail 13. A tape fastening profile 25 with double sided tape is used to attach the single pleated material of the second blind 14. At the bottom of the second blind 14 a bottom rail 15 is attached to provide rigidity and uniform appearance, as well as to hold down the bottom of the second blind 14 when it is extended.

In order to allow selection between the first and second blinds a lift cord 16 is provided. The lift cord 16 passes through the head rail 10 and is attached at its ends to the midrail 13 by means of cord grommets 21. In the embodiments shown the lift cord 16 passes through the center of the blinds, if desired lift cords could be located at the ends or on the outside edges of the blinds. A universal cord guide 17 guides the cord through the head rail and helps to secure the honeycomb blind 11. A cordlock 18 allows the lift cord 16 to be locked in any position as desired. A decorative tassel 19 may be fitted on to the looped end of the lift cord 16.

The blinds 11 and 14 may be made of any material exhibiting the desired properties. If pleated blinds are desired, a material with suitable stiffness to hold pleats and maintain its shape should be chosen. Softer fabrics which would form S-shaped folds may also be used. In the embodiment shown, a cellular or honeycomb material is used for the first blind 11 and a translucent, single pleated fabric for the second blind 14. Different fabrics and colors may be chosen depending on the amount of light which is desired to enter and the decor of the room. It is possible that an insect screen could be selected as material for one of the blinds. It should also be appreciated that the first blind 11 may be omitted, permitting selection between an open space and the second blind 14. In this case the midrail 13 would be suspended only by the lift cords 16.

Figure 4:
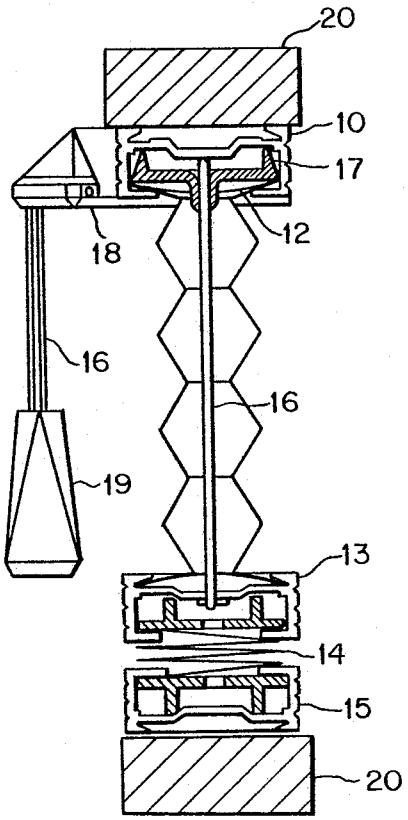
FIG. 4 shows an end view of the shade of FIG. 1 as it might appear in use with the upper blind extended.
Figure 3:
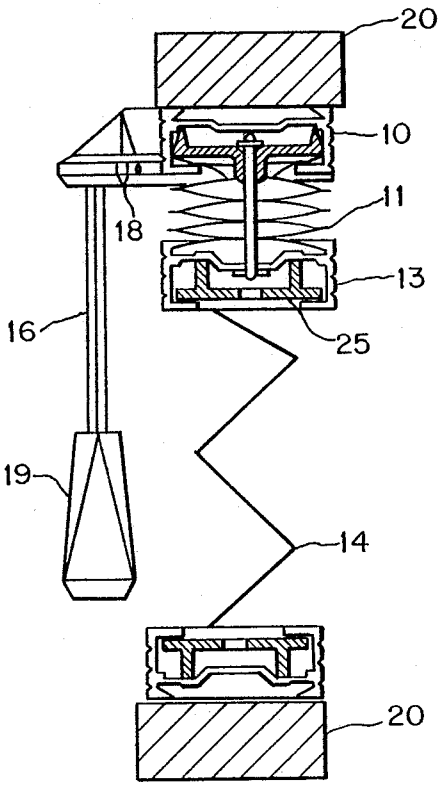
FIG. 3 shows an end view of the shade of FIG. 1 as it might appear in use with the lower blind extended.

FIGS. 3 and 4 depict a two position over-under shade in a possible operation configuration. In FIG. 3 the shade is located inside a a window frame 20. The head rail 10 may be attached to the window frame 20 by screws or other suitable fastening means. The bottom rail 15 rests freely on the window frame 20. The lift cord 16 is drawn up and locked in the cordlock 18 so that the first blind 11 is collapsed against the head rail 10 and the second blind 14 is extended across the window opening. In FIG. 4 the lift cord 16 is released from the cordlock 18 and the midrail 13 is lowered, collapsing the second blind 14 and allowing the first blind 11 to extend across the window opening. The bottom rail 15 remains resting freely on the window frame. In this manner one may select between two different window coverings.

Figure 5:
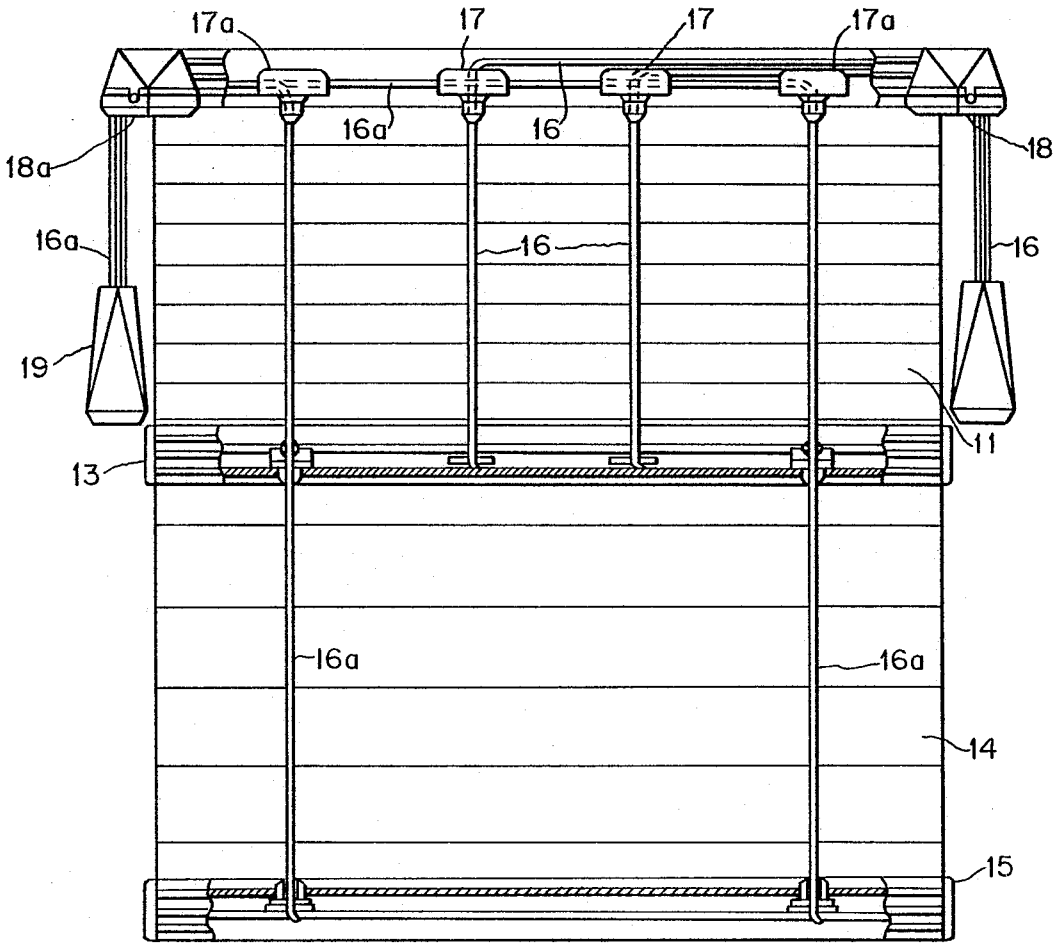
FIG. 5 shows an elevation view of a three position over-under shade of the present invention.
Figure 6:
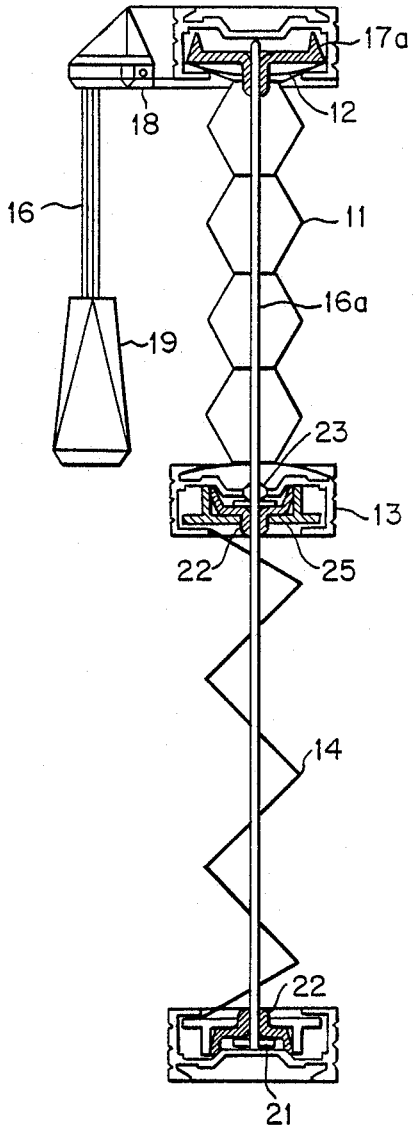
FIG. 6 shows an end view of the shade of FIG. 5.

FIGS. 5 and 6 show a three position over-under shade of the present invention. This shade is essentially the same as the two position shade shown in FIGS. 1 and 2, with the exception that a second set of lift cords **16*a* is added to provide a means of raising and lowering the bottom rail 15 independent of the midrail 13**.

The addition of the second set of lift cords **16*a* requires two additional universal cord guides 17*a* in the head rail 10 to guide the second lift cord 16*a*, and an additional cordlock 18*a*. Also, extrusion grommet 22 and head rail grommets 23 are located in the midrail 13 to guide the second lift cord 16*a* through and prevent excessive wear by rubbing against the midrail 13. Extrusion grommets 22 also may be located in the bottom rail 15. The second lift cord 16*a* is anchored in the bottom rail 15 by cord grommets 21**.

The three position shade operates in a similar fashion to the two position shade, except that the second lift cord **16*a* allows the bottom rail 15 to be drawn all the way up to the head rail 10 for a completely unobstructed window opening. Also, because the bottom rail 15 is suspended from the second set of lift cords 16*a*** it need not rest on the window frame or be suspended by other means as in the two position shade. Again, it should be apparent that any suitable material may be used in the blind. This could include insect screen or transparent plastics. Also, again, one of the blinds may be left out to create an open space.

Figure 8:
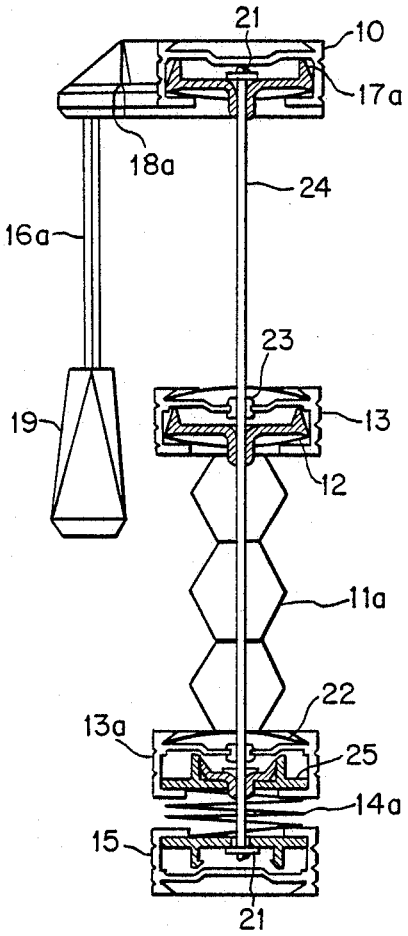
FIG. 8 shows a section view through section line A—A of the shade of FIG. 7.
Figure 7:
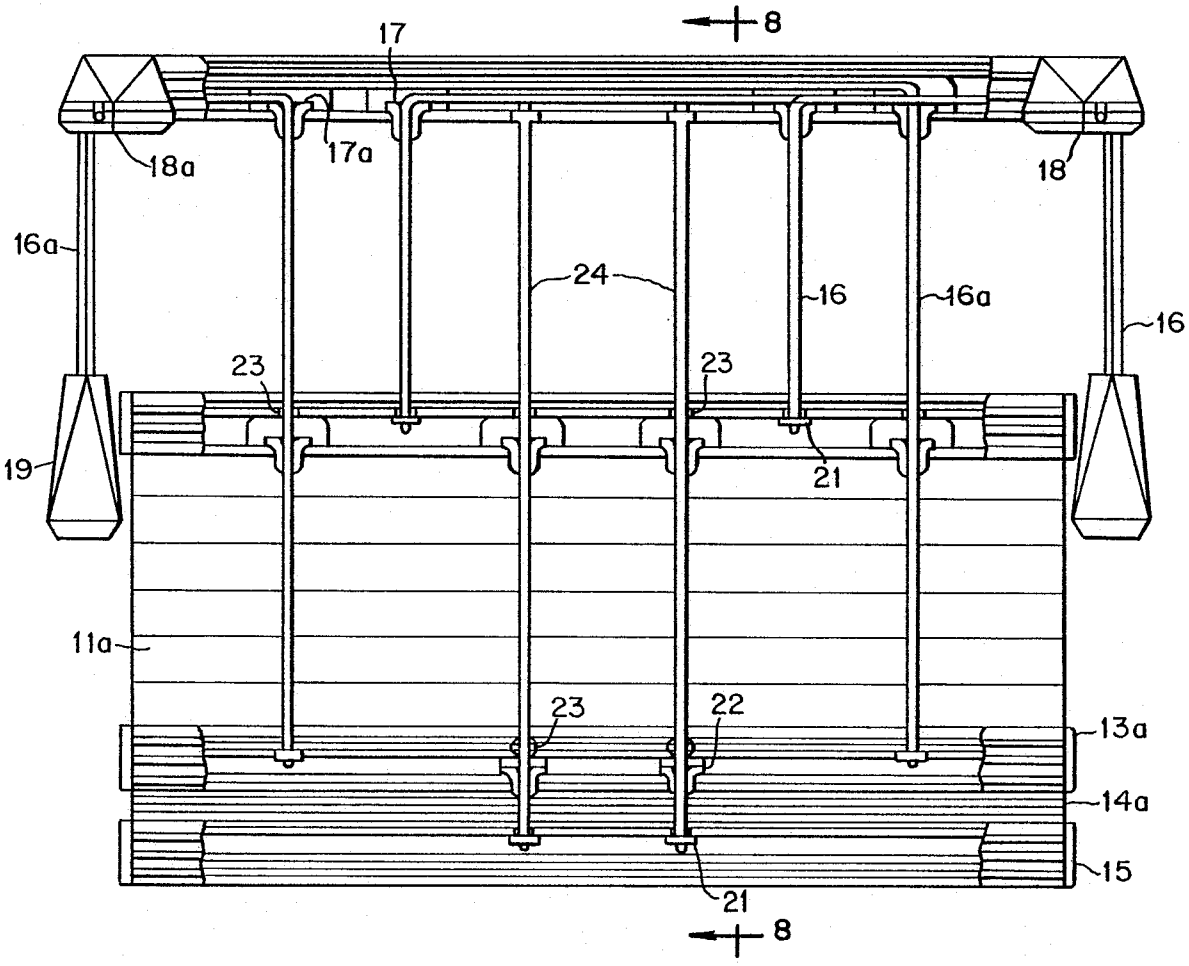
FIG. 7 shows an elevation view of a three position over-under shade of the present invention with an additional midrail and fixed bottom rail.

In an alternative embodiment of the three position shade, shown in FIGS. 7 and 8, a second midrail **13*a* is added to which the second lift cord 16*a* is affixed. The bottom rail 15 is then suspended by fixed cords 24 which are guided through the midrails 13, 13*a* by head rail grommets 23 and extrusion grommets 22. The fixed cords 24 are anchored in the bottom rail 15 by cord grommets 21. In this case the space between the head rail 10 and the first midrail 13 is left open. A first blind 11*a* of cellular or honeycomb material occupies the space between the first midrail 13 and the second midrail 13*a*. A second blind 14*a* of single pleated material occupies the space between the second midrail 13*a* and the bottom rail 15**.

In this configuration the bottom rail 15 remains suspended from the fixed cords 24 in its lower position. The two lift cords 16, **16*a* allow choice between the open space or the first or second blinds 11*a*, 14*a***. If desired a third blind may be used in place of the open space, or the order of open spaces and blinds may be rearranged.

I claim:

1. A three position window shade comprising:

(a) a head rail having top and bottom sides and two ends;

(b) a first midrail having top and bottom sides and two ends;

(c) a second midrail having top and bottom sides and two ends;

(d) a first lift cord passing through the head rail and affixed to the first midrail, providing a means of raising and lowering the first midrail;

(e) a bottom rail having top and bottom sides and two ends;

(f) a second lift cord passing through the head rail and affixed to the second midrail, providing a means of raising and lowering the second midrail.

(g) support means for supporting the bottom rail; and (h) at least two blinds located between and attached to the head rail and first midrail, the first midrail and second midrail, and the second midrail and bottom rail.

2. The window shade according to claim 1, having two blinds wherein:

(a) the first blind is made of a pleated insulating material; and (b) the second blind is made of a single pleat material whereby a choice of insulating cover is provided for the window without altering the visual appearance of the window shade.

3. The window shade of claim 2 wherein:

the pleated insulating material is made of two, side-by-side layers of single pleat material.

4. The window shade of claim 2 wherein:

the pleated insulating material is made with a blind having a cellular structure.

5. The window shade according to claim 1 wherein:

(a) the head rail has a first cord opening at one end and a second cord opening at the other of said ends; and (b) the first cord opening provides a passageway for the first lift cord and the second cord opening provides a passageway for the second lift cord.

6. A three position window shade comprising:

(a) a head rail having top and bottom sides and two ends;

(b) a first midrail having top and bottom sides and two ends;

(c) a second midrail having top and bottom sides and two ends;

(d) a first lift cord passing through the head rail and affixed to the first midrail, providing a means of raising and lowering the first midrail;

(e) a bottom rail having top and bottom sides and two ends;

(f) a second lift cord passing through the head rail and affixed to the second midrail.

(g) a support means for supporting the bottom rail; and (h) at least two blinds located between and attached to the head rail and first midrail, the first midrail and second midrail, and the second midrail and bottom rail, the first of said at least two blinds being fabricated from a pleated insulating material of cellular structure and the second of said at least two blinds being fabricated from a single pleat material whereby a choice of insulating cover is provided for the window without altering the visual appearance of the window shade.

* * * * *